US007204061B2

(12) United States Patent
Terabe et al.

(10) Patent No.: US 7,204,061 B2
(45) Date of Patent: Apr. 17, 2007

(54) FIREPROOF STRUCTURE AND INSTALLATION METHOD FOR PROTECTING WATER PIPES

(75) Inventors: Yasunori Terabe, Yokohama (JP); Keita Inoue, Yokohama (JP); Yuji Nakagawa, Yokohama (JP); Kentaro Saeki, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 68 days.

(21) Appl. No.: 10/289,406

(22) Filed: Nov. 7, 2002

(65) Prior Publication Data

US 2003/0084623 A1 May 8, 2003

(30) Foreign Application Priority Data

Nov. 8, 2001 (JP) ..... 2001-343789

(51) Int. Cl.
*F27D 1/14* (2006.01)

(52) U.S. Cl. ..... 52/506.02; 52/385; 52/513; 122/511

(58) Field of Classification Search ..... 52/506.02, 52/506.03, 506.04; 432/234; 122/511
See application file for complete search history.

(56) References Cited

U.S. PATENT DOCUMENTS

| | | | | |
|---|---|---|---|---|
| 2,077,410 A | | 4/1937 | Harter et al. | 122/6 |
| 3,881,864 A | * | 5/1975 | Nicol | 432/234 |
| 3,941,160 A | * | 3/1976 | Campbell, Jr. | 138/178 |
| 4,140,483 A | * | 2/1979 | Errington | 432/234 |
| 4,149,846 A | * | 4/1979 | Drew, Jr. | 432/234 |
| 5,154,605 A | * | 10/1992 | Suey | 432/234 |
| 5,547,768 A | * | 8/1996 | Topolski et al. | 428/632 |
| 5,673,527 A | * | 10/1997 | Coston et al. | 52/506.02 |
| 5,940,951 A | * | 8/1999 | Schulz et al. | 29/421.1 |
| 6,012,401 A | * | 1/2000 | Orita et al. | 110/325 |
| 6,360,700 B1 | * | 3/2002 | Kern | 122/511 |
| 6,412,548 B1 | * | 7/2002 | Terashima et al. | 165/134.1 |
| 6,487,980 B2 | * | 12/2002 | Wilhelmi et al. | 110/336 |

FOREIGN PATENT DOCUMENTS

DE 9017334 3/1991

(Continued)

*Primary Examiner*—Ramón O. Ramirez
*Assistant Examiner*—Steven Marsh
(74) *Attorney, Agent, or Firm*—Wenderoth, Lind & Ponack, L.L.P.

(57) ABSTRACT

A fireproof structure protects water pipes with stable durability even in a high temperature gas environment. Even in a case where it falls off, it does not leave the water pipes suddenly exposed. The fireproof structure for protecting water pipes 25B installed on water pipe walls of a combustion gas side is configured by a double-layered structure made up of an outer layer water pipe protective structure facing towards the combustion gas side, which is fireproof tile 13, and an inner layer water pipe protective structure provided between the outer layer water pipe protective structure and the water pipes, which is fireproof castable 12. The thickness ratio between the castable 12 and the tiles 13 lies within the range of about 2:1 to 3:1, and the ratio between the thickness of the fireproof castable and the radius of the water pipe is set to 1+α:1, wherein the value of α ranges from approximately 0.1 to 0.3. The water pipes are equipped with hanging hooks 15*a* for tiles 13.

5 Claims, 8 Drawing Sheets

FOREIGN PATENT DOCUMENTS

| | | | |
|---|---|---|---|
| DE | 4335707 | A1 | 4/1995 |
| DE | 19825546 | C1 | 8/1999 |
| EP | 0854321 | A1 | 7/1998 |
| EP | 0 964 205 | | 12/1999 |
| EP | 0962696 | A1 | 12/1999 |
| FR | 2495284 | | 6/1982 |

* cited by examiner

FIREPROOF STRUCTURE AND INSTALLATION METHOD FOR PROTECTING WATER PIPES

BACKGROUND OF THE INVENTION

1. Field of the Invention

The present invention relates to a fireproof structure and installation method for water pipes used in heat exchangers in incinerators, boilers and the like which protects them in high temperature gas environments.

2. Description of the Related Art

Water pipes are installed inside of trash incinerators, boilers and the like to cool the high temperature gas environment or perform heat exchange. Those water pipes have been protected from not only the high temperature gas environment, but the abrasion from flying ash and corrosion, by the installation of fireproof tiles or fireproof castable structures around the inside of the furnace walls.

Such conventional fireproof structures, as shown in FIG. 9, have studs 14 protruding from water pipes 10 on the combustion chamber side of the water pipe wall, in other words, the side in contact with the high temperature gases. Also employed are sleeves 19 embedded inside fireproof castable 12; the foregoing studs 14 inserted into the sleeves 19 are held by the foregoing fireproof castable 12.

The foregoing fireproof castable 12 contains SiC, which exhibits high thermal conductivity and is chemically stable. The foregoing studs 14 are made of stainless steel materials, and the sleeves 19 are made of ceramic material. The sleeves 19 protect the foregoing studs 14 from corrosion by the waste gases and further serve to prevent the fireproof castable from cracking and chipping off due to studs 14.

This structural method for fireproof structures using fireproof castable materials was disclosed in Japan Patent Publication Hei 8-21688 (1996).

Also, Japan Patent Publication 2000-167816 proposed a fireproof tile using SiC and other ceramic raw materials. FIGS. 10 and 11 show a fireproof structure using the fireproof tiles disclosed in that invention.

In that structure, fins 11 that join adjacent water pipes 10 include projecting hanging members 15*d*. The hanging members 15*d* affix fireproof tiles 13 with mortar 20 on the high temperature gas side of water pipes 10 through the projecting hanging member.

As is shown in the side view, FIG. 11, the hanging members 15*d* comprise an L-shaped support hook. The L-shaped hooks provide support by allowing insertion of the fireproof tiles from above, which tiles are equipped with attachment holes.

However, the problem with the above described fireproof castable is that because it is of irregular dimensions, being coated or sprayed directly onto the walls of the water pipes, the durability of the resulting fireproof structure becomes unstable; after a few years, it tends to massively flake away or collapse. With regard to the fireproof structure comprised of the externally formed and manufactured fireproof tiles described above, even though the tiles themselves have excellent durability, should any of them fall off, the water pipe can be directly exposed, and be damaged by the high temperatures and corrosive gasses.

In particular, when used in the stoker-type incinerators where the outlet temperatures can reach to an extremely high 1000° C., the difference between the thermal expansion of the support members for the fireproof structures using the foregoing fireproof castables or fireproof tiles, and that of the fireproof structure, causes cracks to form where combustion gases can invade and subsequently corrode the foregoing support members. As a result, the foregoing fireproof structures are prone to separation and falling away, thereby allowing holes to form in the water piping.

SUMMARY OF THE INVENTION

The present invention addresses the problems associated with the prior art. Its objective is to provide a fireproof structure for protecting water pipes and an installation method employing a fire proof structure which, even in the case where it falls off, does not leave the water pipes suddenly exposed, and even if the fireproof structure comes into contact with high temperature combustion gases, the fireproof structure assures protection for the water pipes and support members.

At this point, the present invention, in order to resolve these problems, provides a fireproof structure for protecting water pipes installed on the water pipe walls of the combustion gas side used for trash incinerators, boilers or other combustion equipment. It is characterized by the following. The fireproof structure is configured by a double-layered structure consisting of an outer layer water pipe protective structure facing towards the combustion gas side, and an inner layer water pipe protective structure provided between the outer layer water pipe protective structure and the water pipes. The outer layer water pipe protective structure and the inner layer water pipe protective structure are formed from different materials. The outer layer water pipe protective structure is comprised of a fireproof castable or fireproof tile, and the inner layer water pipe protective structure is selected from a cladding deposit, thermal spraying deposit, or fireproof castable.

The present invention, characterized by providing a double-layered fireproof structure to cover water pipes, each deriving fireproof properties from different substances, provides assured protection from corrosion and abrasion in the high temperature gas environment. The foregoing fireproof tile exhibits high durability due to its high specific density and uniform density distribution. The foregoing fireproof castable is easily installed, and should it fall off or crumble, the water pipes are not suddenly exposed. Further, the aforementioned cladding deposit has a thermal expansion rate that is similar to that of the water pipes to thereby provide assured protection without cracking.

These fireproof structures can be used in the following combinations, for example, (in the order of outer layer water pipe protective structure—inner layer water pipe protective structure) fireproof tile—fireproof castable, fireproof tile—cladding deposit, fireproof tile—thermal spraying deposit, fireproof castable—cladding deposit, and fireproof castable—thermal spraying deposit.

Thus, the problems with the prior art cited above may be resolved by using these combinations of materials, providing assured protection of the water pipes.

The use of silicon carbide or bonded silicon nitride and silicon carbide is recommended in the foregoing fireproof tile and fireproof castable to improve their heat exchange efficiency. High corrosion resistant nickel-chrome, Ni based alloy, or the like are recommended for the foregoing cladding or thermal spraying deposits.

Another aspect of the invention is characterized by the fireproof structure installed on the water pipe walls in stoker type incinerators having a furnace outlet temperature of approximately 900 to 1200° C.

Yet another aspect of the invention is characterized by the fireproof structure used for the water pipes of stoker type incinerators having a furnace outlet temperature of approximately 900 to 1200° C. at the uppermost fireproof structure in the furnace.

A further aspect of the invention is characterized in that the furnace outlet is approximately 900 to 1200° C. at the upper most fireproof structure in the furnace.

The outlet temperature in furnaces means generally the temperature in the uppermost part where the fireproofing is applied in the furnace.

These inventions are applicable especially for furnaces in the widely spread stoker type incinerators, which operate at high temperatures. If the inside of the furnace is high temperature, the thermal expansion is huge. In such case, there is a big difference in the thermal expansions between the supports provided to the water pipes and the fireproof structure. This causes cracking and damage to the conventional, single-layered fireproof structures, and allows holes to form in the water pipes. Accordingly, the above described double-layered fireproof structure provides assured protection of the water pipes even in high temperature gas environments.

Further, another aspect of the invention is characterized by the fireproof structure for protecting water pipes which is provided with a fireproof castable for areas where the water pipes assume a complex shape, and a fireproof tile for areas where the water pipes assume an approximately linear shape.

This arrangement allows the easy installation of fireproofing in areas where the water pipes are arrayed in a complex shape by using an amorphous fireproof castable rather than fireproof tiles when dealing with areas where there are bends and projections in the water pipes, such as around manholes (openings for worker egress), air ducts, and openings for the insertion of measuring equipment.

Further still, another aspect of the invention relates to a fireproof structure for protecting water pipes which is characterized as follows. The fireproof structure is installed in a stoker type incinerator which has a secondary air duct at the lower part of the inner wall of the furnace. The outer layer water pipe protective structure for the water pipes, installed in the area around and the lower area of the secondary air ducts, is a fireproof castable, and the inner layer water pipe protective structure is a cladding deposit or a thermal spraying deposit.

The foregoing stoker type incinerators use primary air which is supplied from the bottom of the furnace and secondary air which is supplied from the lower area of the inner furnace walls. The secondary air is used to control combustion. Further, it is often the case that a complex water pipe structure exists at the secondary air ducts, around and below them. Accordingly, it would be cost effective and easy to install a fireproof castable, cladding deposit, or thermal spraying deposit having uneven surfaces in such areas.

Further, in the vicinity of the foregoing secondary air ducts, where harsh air blasts are apt to cause considerable damage, it is possible to assure the protection of the water pipes by employing an inner layer water pipe protective structure comprised of a cladding deposit or thermal spraying deposit.

Also, another aspect of the invention is characterized by that the fireproof structure, in at least the areas where the water pipe walls are subject to high heat loads, is configured by the outer layer water pipe protective structure being formed by fireproof tiles and the inner layer water pipe protective structure being formed by a cladding deposit or as a thermal spraying deposit.

With this arrangement, placing highly heat resistant fireproof tiles in areas subjected to high heat loads makes it possible to prevent damage or degradation due to the high heat loads, reduces the frequency of maintenance, and minimizes operating costs.

Yet another aspect of this invention is characterized by the outer layer water pipe protective structure being formed by fireproof tiles, and hanging members being provided on the water pipes of the water pipe walls to hang the fireproof tiles on the walls.

Thus, by integrating the foregoing hanging members, which support the aforementioned fireproof tiles, on the water pipes, being the flow path for the cooling water, there is no concern for heat damage to the hanging members because they are cooled. Further, the foregoing hanging members, being L-shaped or similarly shaped hanging members, prevent the tiles from falling off.

Yet another aspect of this invention is characterized by the outer layer water pipe protective structure being formed by fireproof tiles, and the inner layer water pipe protective structure being formed by fireproof castable, with the thickness ratio between the castable and the tiles lying within the range of about 2:1 to 3:1.

The combination of the foregoing fireproof tiles and the forgoing fireproof castable of this invention serves to improve durability and to protect the water pipes with the fireproof castable, thereby preventing their exposure in the event that one of the foregoing fireproof tiles falls off.

In this case, should the thickness ratio of the foregoing fireproof castable be less than the 2:1 specified above, should any fireproof tiles fall off, the thinnest areas of the fireproof castable covering the water pipes would not be thick enough to prevent the water pipe from being suddenly exposed. On the other hand, if the wall thickness ratio of the foregoing fireproof castable exceeds 3:1, then the cooling effects by the water pipes on the fireproof tiles would be diminished, which would in turn decrease the durability of the hanging members of the fireproof tiles.

Accordingly, maintaining the foregoing thickness ratio at between about 2:1 and 3:1 assures the protection of the water pipes and additionally improves the durability of the hanging members.

Further, another aspect of this invention is characterized by the outer layer water pipe protective structure being formed by fireproof tiles, the inner layer water pipe protective structure being formed by fireproof castable, and the ratio between the thickness of the fireproof castable and the radius of the water pipe being set to $1+\alpha:1$, with the value of $\alpha$ ranging from approximately 0.1 to 0.3.

The ratio in this invention of $1+\alpha:1$ (where $\alpha$=approximately 0.1 to 0.3), similar to the case with the foregoing aspect of the invention mentioned above, assures that in the case that a fireproof tile falls off, the water pipe will not become immediately exposed, and that relationship also assures that a high cooling effect will be imparted to the foregoing fireproof tiles' hanging members.

What is meant by the thickness of the foregoing fireproof castable is the thickness from the fins connecting the foregoing water pipes to the surface of the fireproof castable.

Further, since the fireproof castable is held between the foregoing fireproof tiles and the water pipes, by means of appropriately selecting the thickness of said fireproof castable as described above, it is possible to use flat fireproof tiles, which facilitates installation and manufacturing and keeps installation costs low.

Further, other aspects of this invention relate to installation methods for the foregoing fireproof structures of this invention. The installation method for a fireproof structure for protecting water pipes installed on the water pipe walls of the combustion gas side used for incinerators, boilers or other combustion equipment is characterized by comprising a structural installation process for an inner protective layer for the water pipes to install one material from a cladding deposit, thermal spraying deposit and fireproof castable over the water pipe walls facing the combustion gas side, and a structural installation process for an outer protective layer for the water pipes to be installed upon the surface above the inner protective layer for water pipes, a fireproof castable or fireproof tiles, wherein the inner protective layer and the outer protective layer for water pipes consist of differing materials.

Also, another aspect of this invention is characterized by an installation method for a fireproof structure for protecting water pipes installed on the water pipe walls of the combustion gas side used for incinerators, boilers or other combustion equipment, comprising a fireproof castable installation process to install a fireproof castable over the water pipe walls facing the combustion gas side and a fireproof tile installation process to apply an adhesive, such as mortar or the like, on the surface of the fireproof castable, and then fix fireproof tiles thereon.

Further, another aspect of this invention is characterized by an installation method for a fireproof structure mentioned above, further comprising a water drain process to drain water from the pre-formed holes in connecting fins joining the adjacent water pipes after the fireproof tile installation process and a hole plug process to plug the remaining holes after draining the water.

The installation methods mentioned above are for installing the fireproof structure for protecting water pipes mentioned previously. Since these inventions involve first directly installing an amorphous structure over the water pipes, it is possible to perform such installations over the irregular surface formed by the water pipes. Further, should the water pipes have complex shapes including bends or projections, it is still possible to install a fireproof castable for the outer protective layer for the water pipes and avoid the need and associated costs of manufacturing several different shapes/types of fireproof tiles.

The inventions described above involve installation methods for an outer protective layer for water pipes of fireproof tiles, and an inner protective layer of fireproof castable. The water drainage from the fireproof castable held under the fireproof tiles or cladding deposit or thermal spraying deposit is drained through the holes in the aforementioned fins, and after the drainage is performed, welding or other methods is used to plug the holes. Thus, having holes preformed in the foregoing fins facilitates the water drainage.

DETAILED DESCRIPTION OF THE PREFERRED EMBODIMENTS

In this section we shall explain several preferred embodiments of this invention with reference to the appended drawings. Whenever the size, materials, shapes, relative positions and other aspects of the parts described in the embodiments are not clearly defined, the scope of the invention is not limited only to the parts shown, which are meant merely for the purpose of illustration.

Figure 1:
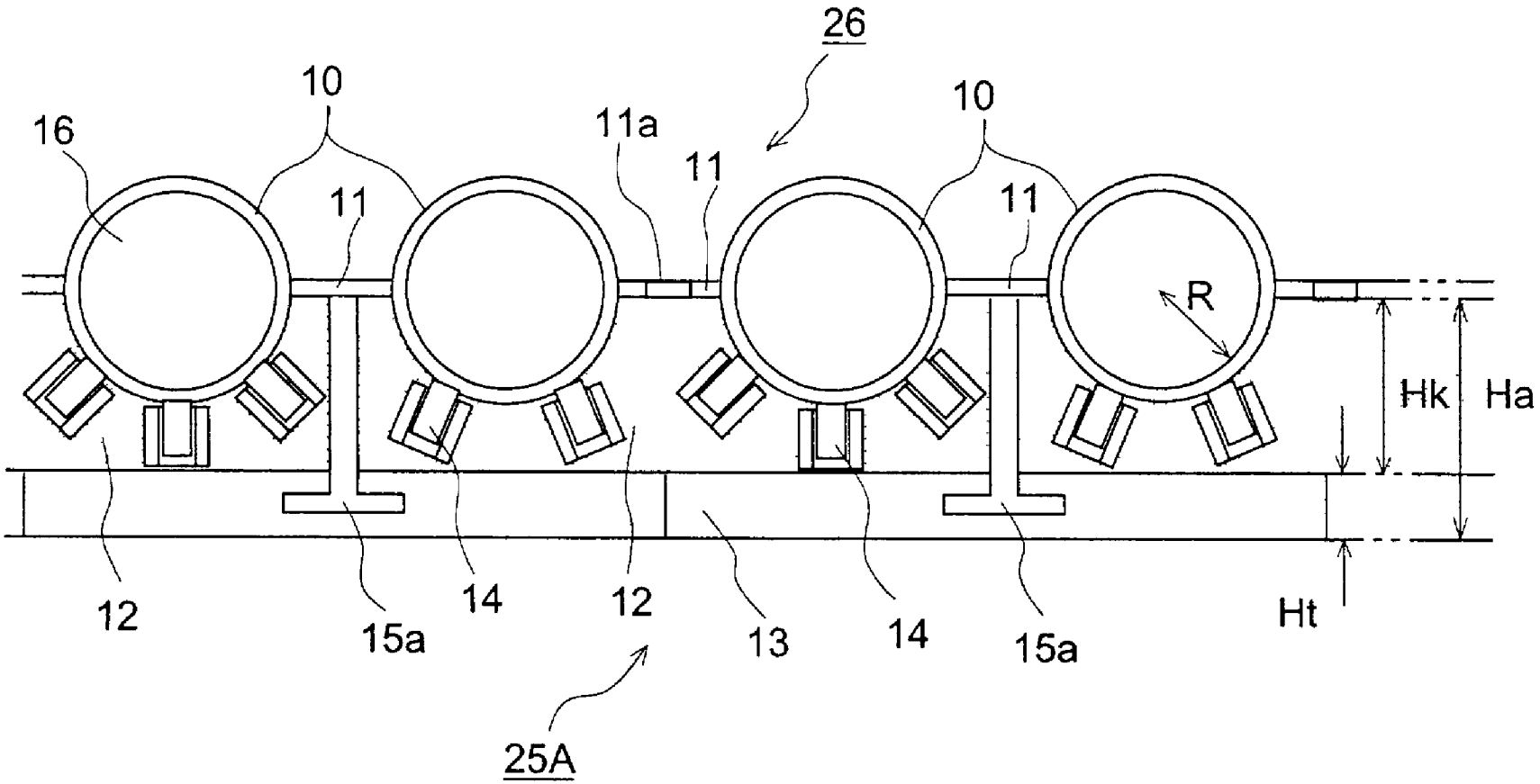
FIG. 1 is a cross sectional view of a first embodiment of this invention showing a fireproof protective structure for water pipes.
Figure 2:
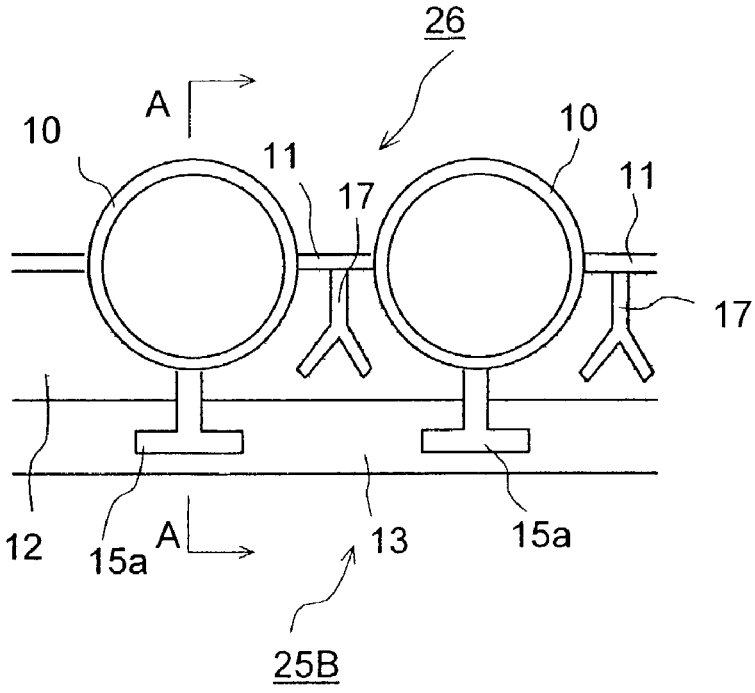
FIG. 2 is a cross sectional view of a second embodiment showing the fireproof protective structure for water pipes.

FIG. 1 is a cross sectional view of a first embodiment showing the fireproof protective structure for water pipes; FIG. 2 is a cross sectional view of a second embodiment showing the fireproof protective structure for water pipes; FIG. 3 and FIGS. 5 through 7 show the third through sixth embodiments of the present invention in cross sectional views.

In these embodiments, a stoker type of incinerator is taken as an example for the installation of the fireproof structure. Further, the outlet temperature of this stoker type incinerator is in the range of, approximately, 900 to 1200° C., and the furnace wall temperature will rise to about 800° C.

In FIGS. 1–7, 10 represents water pipes, 16 a coolant flow path, and 11 the flat surfaced fins which connect and reinforce the water pipes with each other in the horizontal or perpendicular directions. The water pipes 10 and fins 11 form a water pipe wall structure 26.

12 represents fireproof castable, which is primarily comprised of SiC; similarly, 13 represents fireproof tiles, primarily comprised of SiC. The foregoing fireproof castable 12 may be installed, for example, by spraying the castable over the outside circumferential surface of the water pipes and allowing it to harden, or by erecting a framed mold opposite to the water pipes 10, casting the castable to fill the space, and subsequently allowing it to harden before removing the mold. By contrast, the aforementioned fireproof tiles 13, primarily composed of SiC, are molded in a factory, pressed, sintered or otherwise manufactured in advance, and then the manufactured tiles 13 are installed with mortar or other adhesive material as an attachment component on the wall of the water pipes. In addition to the SiC contained in the forgoing fireproof tiles and castable, there is no limit to the other ingredients, such as SK, and $Si_3N_4$, to improve heat conductivity, or ingredients that improve durability or corrosion resistance, which may be included as desired.

Figure 9:
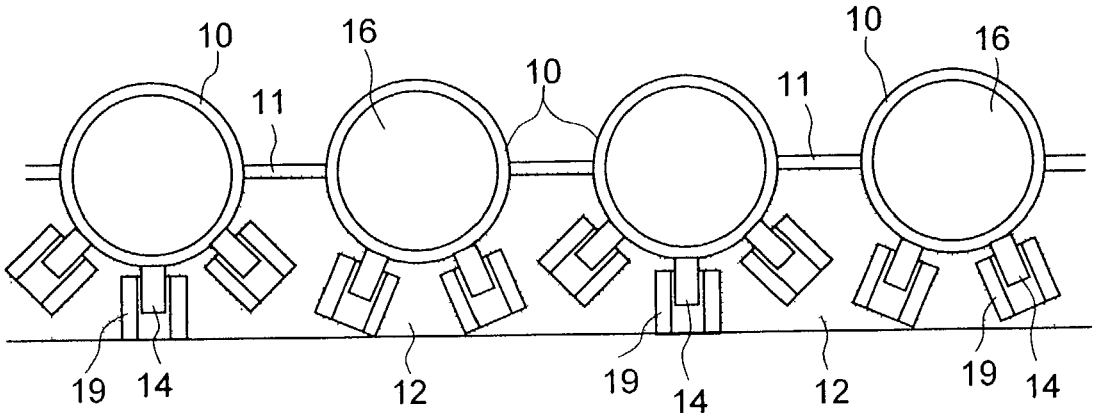
FIG. 9 is a cross sectional view of a conventional fireproof structure for protecting water pipes, which uses fireproof castable.
Figure 10:
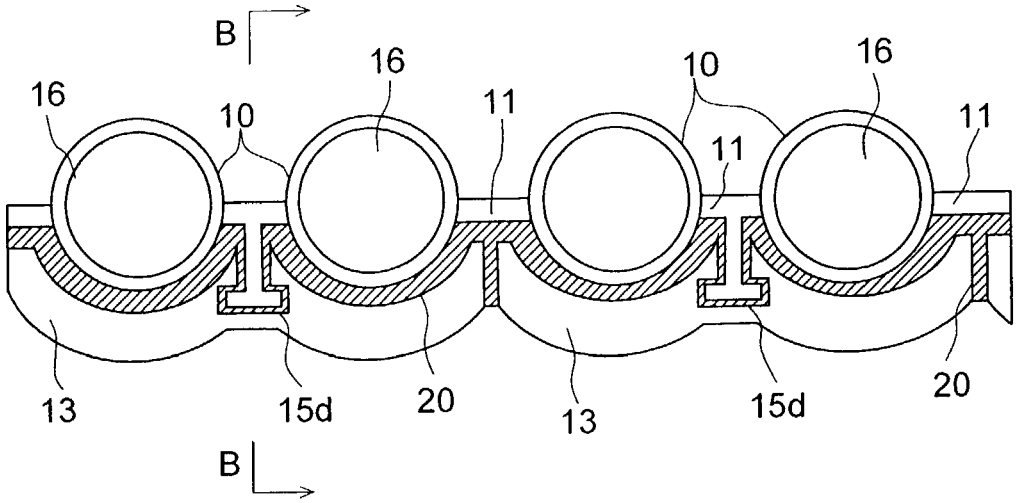
FIG. 10 is a cross sectional view of a conventional fireproof structure for protecting water pipes.

The first embodiment of the fireproof structure 25A according to this invention, as shown in FIG. 1, employs a plurality of studs 14 in sets of two and three, projecting alternately from adjacent water pipes 10 at approximate 45 degree angles on the side where fireproof castable 12 is installed. This structural arrangement makes it very difficult for the fireproof castable 12 to fall off. It is preferable that the studs 14 be made from the same type of material as the water pipes to prevent studs 14 from causing damage due to having a different thermal expansion rate than water pipes 10. It is also desirable, as shown in FIG. 9, that the foregoing studs 14 be inserted into sleeves.

Figure 11:
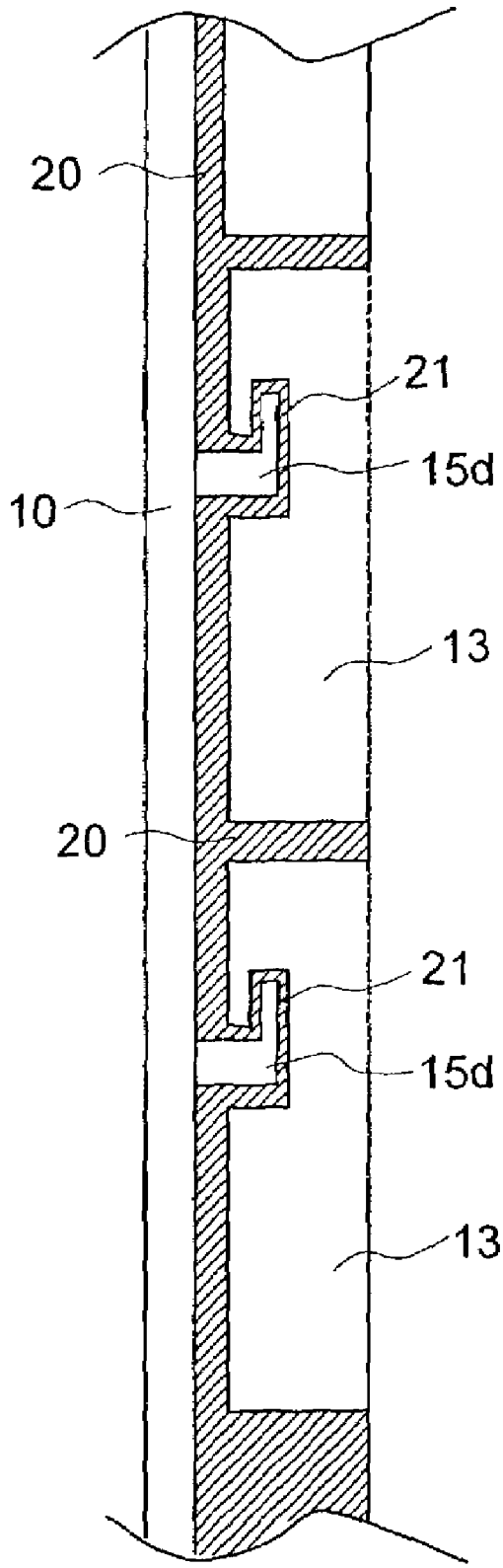
FIG. 11 is a cross sectional view of line B—B shown in FIG. 10.

Further, stainless steel hanging hooks 15*a* have been welded to the foregoing fins 11 to hold the tiles in place. Also, as is shown for fireproof tiles 13 in FIG. 11, the tiles 13 may be held in place by using grooved tiles that engage the hanging hooks 15*a*.

Holes 11*a* have been pre-formed in the foregoing fins 11. These holes 11*a* make it possible to drain the water after the casting of fireproof castable 12 and attaching fireproof tiles 13 by means of the tile-hanging hooks 15*a* to hold the tile in place. Then, after draining the water through holes 11*a*, the holes 11*a* may be plugged by welding, etc., to eliminate the possibility of residual water between the water pipes and the tile, to thereby easily complete the installation of fireproof structure 25A. At this time, it would also be possible to drill holes in the fireproof tile side, and after draining the water from the foregoing fireproof castable 12, such holes also could be plugged with mortar, etc.

In this first embodiment, when the radius R for the water pipes 10 arrayed in this stoker type incinerator is approximately 38 mm, the thickness Ha of the fireproof structure comprised of the foregoing fireproof castable 12 and fireproof tiles 13 is about 70 mm, with the thickness Hk of the foregoing fireproof castable 12 being approximately 50 mm and the thickness Ht of the foregoing tiles 13 being about 20 mm.

Thus, the ratio of the thickness Hk of the foregoing fireproof castable 12 to the thickness Ht of the foregoing fireproof tiles 13, Hk:Ht=2:1 to 3:1, or the ratio of the thickness Hk of the foregoing fireproof castable 12 to the radius R of water pipes 10 is approximately Hk:R=1+α:1. With this structure, in the unlikely event of any of the foregoing fireproof tiles 13 falling off, the water pipes would not become suddenly exposed, and it is further possible to prevent damage to the hanging hooks 15*a* due to the heightened cooling effect on the aforementioned tile hanging hooks 15*a*.

FIG. 2 shows a second embodiment of a fireproof structure 25B, wherein water pipes 10 are arrayed as in the first embodiment and have L-shaped tile hanging hooks 15*a* made of a similar material. The foregoing fins 11 have a Y-shaped anchor 17. Since the other elements of the structure are similar to those of the first embodiment, further explanation of them will be omitted.

Figure 4:
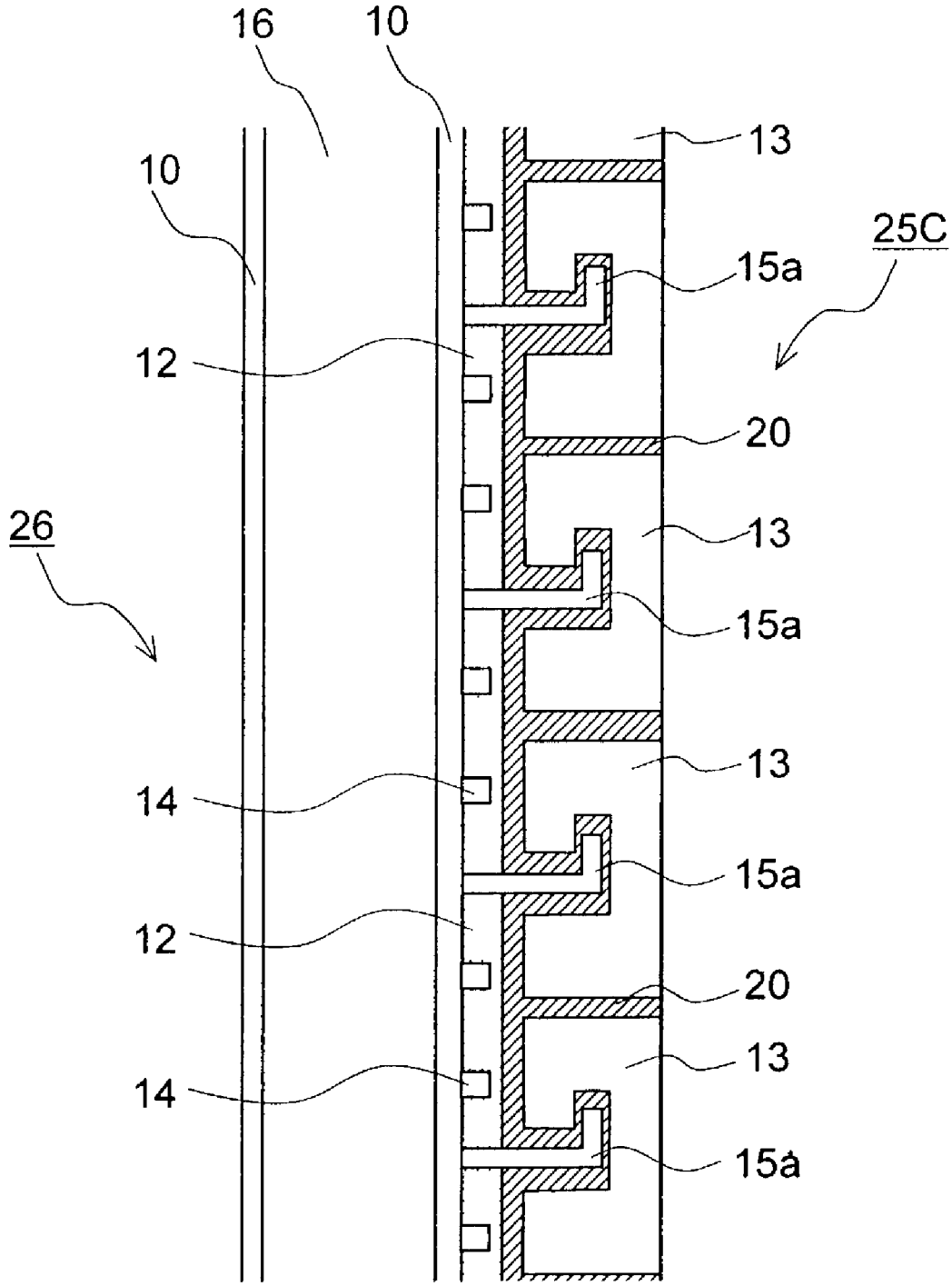
FIG. 4 is a cross sectional view at line A—A shown in FIG. 2.

FIG. 4 is a cross sectional view of the second embodiment taken along line A—A of FIG. 2. 10 is the water pipes forming the coolant path 16, which are covered around their outside circumferences on the side facing the inside of the furnace by fireproof castable 12. Fireproof tiles 13 are installed atop that castable, and are held in place by hanging them onto L-shaped hanging hooks 15*a* and affixing with mortar 20.

Figure 3:
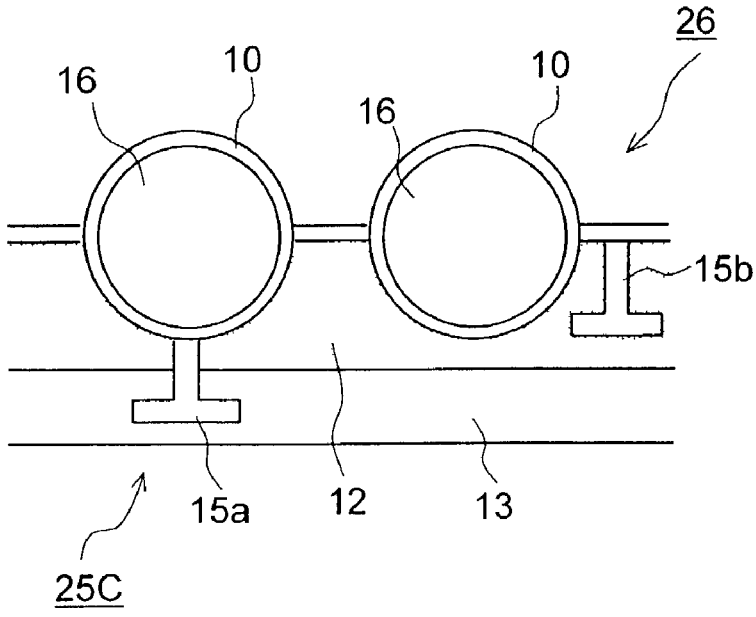
FIG. 3 is a cross sectional view of a third embodiment showing the fireproof protective structure for water pipes.

FIG. 3 shows a third embodiment of fireproof structure 25C. The structure of this third embodiment is similar to those of the first and second embodiments, but the number of parts have been reduced by using the same L-shaped hooks for the tile hanging hooks 15*a* and for the castable support hooks 15*b*.

Since the fireproof structures in these embodiments are two-layered structures comprised of the foregoing fireproof castable 12 and fireproof tiles 13, should any of the fireproof tiles 13 facing the high temperature gas environment suddenly fall off, the foregoing fireproof castable 12 would serve to protect the water pipes in that area to assuredly prevent the exposure of the water pipes.

Further, since the foregoing tile hanging hooks 15*a* protrude from water pipes 10, the cooling effect provided by that structure prevents diminished durability of the hanging hooks 15*a*, even in extremely high temperature stoker type incinerators.

The fireproof tiles 13 used in these embodiments may be flat-shaped tiles, which facilitates their manufacture and installation, and makes them less expensive to produce. Further, one is not confined to using the L-shaped hooks or Y-shaped anchors to retain the fireproof tiles and fireproof castable, and any type of retaining structure or combination thereof may be used to support the fireproof structure.

Figure 5:
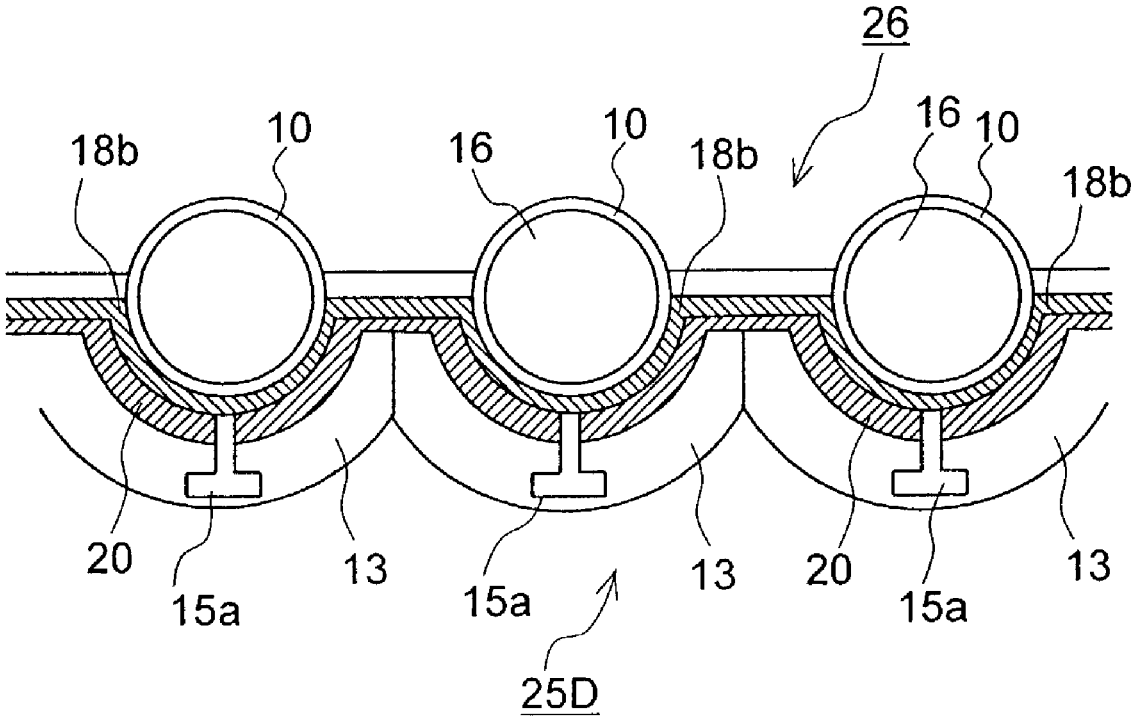
FIG. 5 is a cross sectional view of a fourth embodiment showing the fireproof protective structure for water pipes.

FIG. 5 shows a fourth embodiment, where thermal spraying deposit has been used around the outside circumference of water pipes 10 in making a fireproof structure 25D. In this embodiment, water pipes 10 have been coated with thermal spraying deposit 18*b*, and then fireproof tiles 13 have been installed around the circumferences of that structure. The preferred thickness for thermal spraying deposit 18*b* would range from about 0.1 to 1.0 mm, and the material should be an alloy such as 50 Ni-50 Cr.

It would also be possible to use a cladding deposit other than the foregoing thermal spraying deposit 18*b*. In that case, the thickness of the structure should range from about 1 to 10 mm, and the material used for the build up should be a nickel based alloy such as Inconell.

Figure 6:
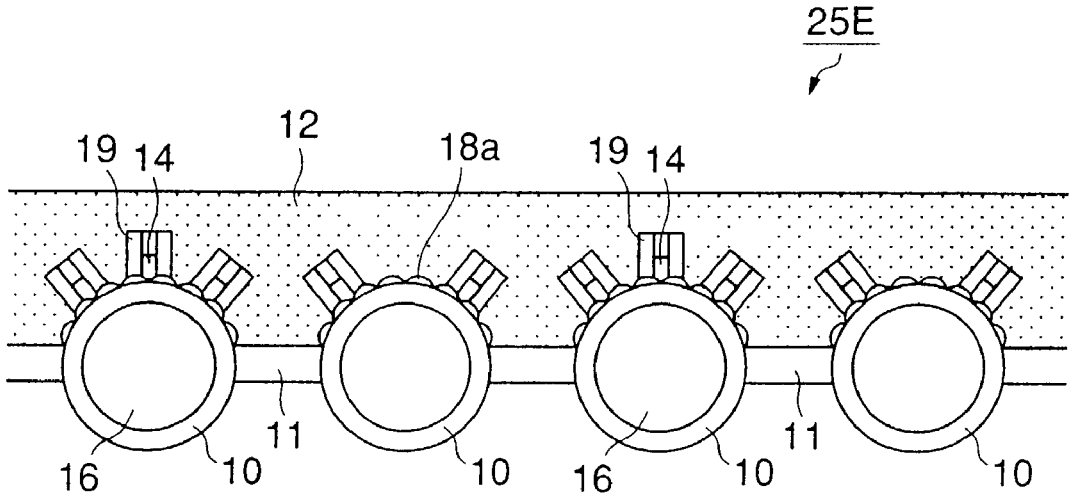
FIG. 6 is a cross sectional view of a fifth embodiment showing the fireproof protective structure for water pipes.

In the fifth embodiment shown in FIG. 6, a nickel based alloy is clad around the outer circumference of water pipes 10, and then fireproof castable 12 is installed thereupon. In this fireproof structure 25E, the inner protective layer for water pipes is cladding deposit 18*a*, while the outer protective layer for water pipes is fireproof castable 12.

Figure 7:
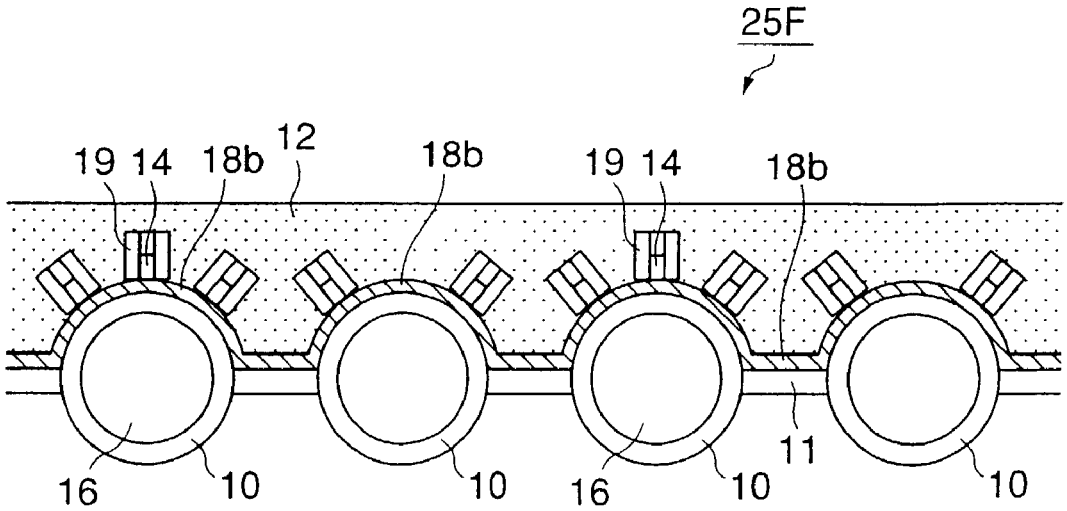
FIG. 7 is a cross sectional view of a sixth embodiment showing the fireproof protective structure for water pipes.

Also, FIG. 7 shows the sixth embodiment, where an Ni—Cr alloy has been applied by thermal spraying around the outer circumference of water pipes 10. The fireproof structure 25F accordingly has an inner protective layer for water pipes of the thermal spraying deposit 18*b*, and an outer protective layer for water pipes of the fireproof castable 12.

The fireproof structures of the fifth and sixth embodiments require no mortar or other adhesive application for the installation of the fireproof castable or for the structure of the cladding deposit 18*a* or thermal spraying deposit 18*b*, and accordingly have fewer layers compared to the conventional use of fireproof tiles, yet still permit the use of studs 14 as support members. The structure is not prone to damage to the support members or the flaking off of layers. The use of sleeves 19 in such applications is recommended.

Thus, using a cladding deposit 18*a* or thermal spraying deposit 18*b* to make molten contact around the outer circumference of water pipes 10 provides strong protection for the water pipes, and even if a fireproof tile 13 should fall off of such a structure, the underlying water pipes would not become exposed.

However, due to the high cost of the cladding deposits 18*a* or thermal spraying deposit 18*b*, the use of these methods may be economically confined to only the high temperature areas inside the furnace. Further, in these embodiments, although the cladding or thermal spraying deposits were used to form the inner protective layer for water pipes, it would also be possible to structure the inner protective layer from fireproof castable materials.

Figure 8:
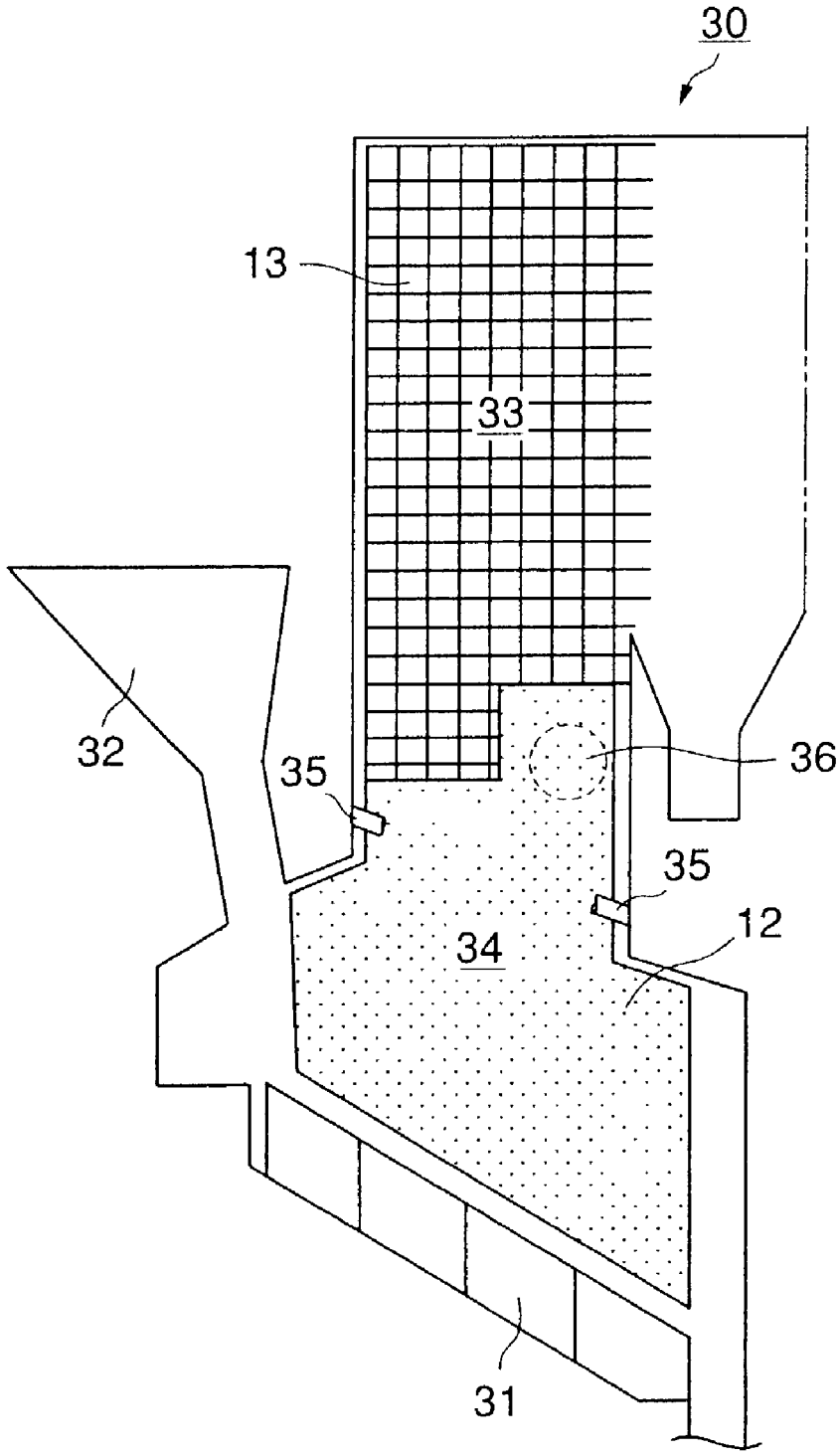
FIG. 8 is a rough overall sketch of the fireproof structure installed in a stoker type incinerator.

Next, the fireproof structure will be described for the case where it is installed in a stoker type incinerator as shown in FIG. 8.

This stoker type incinerator 30 is comprised of input hopper 32 where trash is added, grate 31 where the trash is burned using primary air supplied from the bottom of the incinerator, primary combustion chamber 34 located above grate 31, and secondary combustion chamber 33, located there above, where a supply of secondary air is used to burn the unburned residuals.

The foregoing grate 31 is equipped with a primary air inlet (not shown) which supplies oxygen-enriched air, and secondary air inlet 35 is located below the foregoing secondary combustion chamber 33.

At the bottom of the foregoing secondary combustion chamber 33 is a manhole 36 for the access of workers to perform maintenance, etc. on the burner (not shown), and there are, in addition, several other openings for the insertion of monitoring equipment and the like.

The water pipes installed in the incinerator 30 run roughly linearly in the vertical direction around the foregoing secondary combustion chamber 30, while in the primary combustion chamber 34, they are bent from the vertical toward the grate.

Accordingly, with regard to the fireproof structure installed in incinerator 30, in the areas around and below the foregoing secondary air inlet 35, and around manhole 36, where the water pipes have bends, it is best to install an inner protective layer for water pipes described in the fifth and sixth embodiments, which uses a cladding deposit 18*a* or thermal spraying deposit 18*b* that is covered by an outer protective layer for water pipes comprised of fireproof castable 12. On the other hand, in the area above the foregoing secondary air inlet 35 and where the water pipes run approximately linearly it would be best to use the structures of the first, second, third and fourth embodiments with fireproof tiles 13 as the outer protective layer for the water pipes.

Here, in the areas of high heat loads or around the air inlets where there is a high potential for damage, the water pipes may be protected by partially installing an inner layer water pipe protective structure of a cladding deposit 18*a* or thermal spraying deposit 18*b*. However, in areas where there is little potential for damage, the water pipes may be protected with a single layer of fireproof castable 12 or fireproof tiles 13 to reduce the installation costs.

The foregoing is merely one example of installing a fireproof structure in an incinerator. It is possible to combine the various types of fireproof structures to realize a low cost, durable, high heat resistant fireproof structure.

As described above, according to this invention, the fireproof structure covers the water pipes with two layers of differing materials having differing characteristics, so that the combination of the two layers can offset the inherent defects of each material to assure protection of the water pipes against the high temperature gas environment and abrasion.

Further, even in cases where installation is performed in stoker type incinerators, which generate temperatures of 900 to 1200° C. around the openings, installing a double-layered fireproof structure according to the present invention can prevent damage derived from differences in thermal expansion rates as well as declines in the structure's durability.

Further, by providing the foregoing hanging members which support the aforementioned fireproof tiles on the water pipes, forming the flow path for the cooling water, there is no concern for heat damage to the hanging members, because they are cooled. Further, the foregoing hanging members, being L-shaped hanging members, are prevented from being directly exposed in the combustion gas environment, which prevents the hanging members from being over-heated.

Also, setting the thickness ratio between the foregoing fireproof castable and the fireproof tile to about 2:1 to 3:1, or the ratio of the thickness of the foregoing castable and the radius of the foregoing water pipe to $1+\alpha:1$, with $\alpha$=approximately 0.1 to 0.3, assures that the water pipes are protected and at the same time improves the durability of the support members.

Furthermore, production can be simplified and costs can be lowered by using flat tiles for the foregoing fireproof tiles, and this additionally simplifies their installation.

Further still, one can simplify the installation process over water pipes having complex shapes by using cladding deposit or thermal spraying deposit for the inner protective layer for water pipes and a fireproof castable for the outer protective layer to realize a higher durability, abrasion resistant, and highly fireproof structure.

The invention claimed is:

1. An installation method for a fireproof structure for protecting water pipes installed on water pipe walls of a combustion gas side of combustion equipment, said method comprising:

installing a fireproof castable over the water pipe walls facing the combustion gas side;

attaching an attachment component on a surface of the fireproof castable and then fixing fireproof tiles with said attachment component;

draining water from pre-formed holes in connecting fins joining adjacent ones of the water pipes of the water pipe walls; and plugging the pre-formed holes by welding after said draining.

2. The method of claim 1, wherein the attachment component comprises mortar.

3. A method of forming a fireproof structure of combustion equipment including a refractory tube wall lining and a tube wall comprising water pipes and water pipe connecting fins joining adjacent ones of the water pipes of the tube wall, said method comprising:

attaching adhesive material over the combustion gas side of said tube wall and then installing fireproof tiles on the surface of the castable to be fixed with the adhesive material;

draining water from pre-formed holes on said connecting fins joining adjacent ones of the water pipes of the tube wall; and plugging the pre-formed holes by welding after said draining.

4. The method of claim 3, wherein said adhesive material is mortar.

5. A method of forming a fireproof structure of combustion equipment including a refractory tube wall lining and a tube wall which comprises water pipes and water pipe connecting fins joining adjacent ones of the water pipes of the tube wall, said tube wall lining being formed on a combustion gas side of combustion equipment, said method comprising:

forming an inner layer on a combustion gas side surface of the tube wall of the fireproof structure by cladding or thermal spraying material selected from the group consisting of nickel-chrome and nickel based alloy;

forming an outer layer on said inner layer formed on the combustion gas side surface of the tube wall of the fireproof structure by attaching fireproof castable or fireproof tiles onto the inner layer;

draining water from pre-formed holes in the connecting fins joining adjacent ones of the water pipes of the tube wall; and plugging the pre-formed holes by welding after said draining;

wherein said cladding or thermal spraying material has a thermal expansion rate similar to that of the water pipes in order to provide protection without cracking.

* * * * *